US007987809B2

(12) United States Patent
Uribe et al.

(10) Patent No.: US 7,987,809 B2
(45) Date of Patent: Aug. 2, 2011

(54) WHISTLE WITH POSSESSION CONTROL INDICATING SYSTEM

(75) Inventors: Luis H. Uribe, Morganville, NJ (US); Anthony J. Palmeri, Holmdel, NJ (US)

(73) Assignee: Luis H. Uribe, Morganville, NJ (US)

( * ) Notice: Subject to any disclaimer, the term of this patent is extended or adjusted under 35 U.S.C. 154(b) by 120 days.

(21) Appl. No.: 12/459,639

(22) Filed: Jul. 6, 2009

(65) Prior Publication Data

US 2011/0000422 A1 Jan. 6, 2011

(51) Int. Cl.
*G10K 5/00* (2006.01)
*G09F 9/00* (2006.01)

(52) U.S. Cl. ..... 116/137 R; 116/225; 116/307; 116/324; 446/204; D10/119.3

(58) Field of Classification Search ..... 116/1, 2, 116/24, 222, 225, 281, 283, 306, 307, 321, 116/324, 137 R; 446/26, 81, 204–206; D10/46.1, D10/116, 119, 116.1, 119.2–119.4, 121
See application file for complete search history.

(56) References Cited

U.S. PATENT DOCUMENTS

| | | | | | |
|---|---|---|---|---|---|
| 3,120,213 | A | | 2/1964 | Mulligan | 116/280 |
| D199,878 | S | * | 12/1964 | Mulligan | D10/119 |
| 4,703,712 | A | * | 11/1987 | Christman | 116/324 |
| 4,738,449 | A | | 4/1988 | Droz | 473/533 |
| 4,821,670 | A | | 4/1989 | Foxcroft et al. | 116/137 R |
| 5,062,381 | A | | 11/1991 | Hendricks | 116/225 |
| 5,515,808 | A | | 5/1996 | Edlund | 116/137 R |
| 6,095,056 | A | | 8/2000 | Schumacher | 108/23 |
| 6,181,236 | B1 | | 1/2001 | Schneider, Jr. | 340/326 |
| 6,582,097 | B2 | * | 6/2003 | Chang | 362/253 |
| 6,603,711 | B2 | * | 8/2003 | Calace | 368/109 |
| 6,796,267 | B2 | * | 9/2004 | DuBarry | 116/308 |
| 2005/0162257 | A1 | * | 7/2005 | Gonzalez | 340/323 R |
| 2006/0171092 | A1 | * | 8/2006 | Corcoran et al. | 361/182 |

FOREIGN PATENT DOCUMENTS

WO WO 2006/123997 11/2006

* cited by examiner

*Primary Examiner* — Amy Cohen Johnson
(74) *Attorney, Agent, or Firm* — Ernest D. Buff; Dave Narasimhan; Ernest D. Buff & Associates LLC

(57) ABSTRACT

A basketball sports whistle having an integral basketball possession indicator at the eye level of the referee enables the referee to accurately determine which team is entitled to possession of the basketball without diverting his eyes from the basketball court. The referee switches the indicator to record a change of ball possession. A friction or detent lock in the integrally constructed indicator prevents the ball possession indicator from being accidentally switched to a different position. The possession indicator element is a friction lock slider, or a pop-up indicator in a see-saw like element with friction or a detent at the axis of the see-saw. It can alternatively be or a single pop-up element that carries either H for home team basketball possession or V for visitor team basketball possession.

10 Claims, 3 Drawing Sheets

PRIOR ART

WHISTLE WITH POSSESSION CONTROL INDICATING SYSTEM

BACKGROUND OF THE INVENTION

1. Field Of The Invention

The present invention relates to sports whistles; and more particularly, to a sports whistle appointed for use by a basketball referee having integral therewith a mechanism that accurately indicates which team is entitled to possession of the ball on the next "turn-over" event.

2. Description of the Prior Art

A number of prior art disclosures are related to whistles used for various games that carry mechanisms adapted to convey information to a referee. For example, signal indicator device are used during foot ball game. These signal indicator devices comprise a whistle equipped with an indicating means that tracks the number of downs. Such a whistle is not suitable for use during a basketball game to determine whether the home or visiting team is entitled to possession of the ball after each "turn-over" event.

U.S. Pat. No. 3,120,213 to Mulligan discloses a signal indicator devise. The Mulligan device is appointed for use during a football game. It includes an audible device, a whistle and a down indicator. It has a whistle and indicating means for keeping track of the number of downs. The whistle does not indicate whether the home team or visiting team is entitled to possession on the next "turn-over" event.

U.S. Pat. No. 4,738,449 to Droz discloses a score marker for tennis. The score marker for tennis includes a U shaped three-slot configuration with adjustable slidable cursors that indicate scores and positions. This device has no whistle. Moreover, the device is not used in a basketball game to signal the referee and players or keep track of ball possession between home team and visitor team.

U.S. Pat. No. 5,062,381 to Hendricks discloses a game data board. The game data board is formed as a planar substrate having an upper surface and lower surface. The game data board has a plurality of slots and sliders for keeping track of game data such as the number of balls or strikes in a base ball game, the number of swimming or running laps, etc. The game data board does not have a whistle and is therefore not readily usable by a referee officiating at a basketball game.

U.S. Pat. No. 5,515,808 to Edlund discloses an alerting mechanism for a whistle. The whistle has a rotatable element with a window that exposes a first paint or a second paint indicating the two positions kept track of by the referee. The whistle has to be physically rotated in order to expose the first or the second indication. Specifically, the referee has to remove the whistle and turn it side ways to look at the whistle to see which color is currently selected. Color change is not indicated in the referee's direct line of sight, thereby preventing the referee from formulating immediate judgments concerning play.

U.S. Pat. No. 6,181,236 to Schneider et al. discloses a sports whistle with audible and visual output signals. Pneumatic pressure of the whistle activates a wireless sensor, the signal from which is picked up by a receiver activating a sound alarm; a TV signal indicates the time when the whistle was blown by the referee. The sports whistle does not keep track of which team has the possession of the ball at any time. It merely keeps track of the whistle blowing event and broadcasts it through a wireless network.

Foreign Patent Application No. WO 2006123997 to Roro discloses means for practicing team games. The device is arranged as a means for refereeing a match in team games. It comprises a housing, the dimensions of which are adapted to be held in the hand by the referee during the match. The housing is comprised of a timing member in the form of an electronic clock, a distance-measurement member comprising a transmitter and receiver of distance-measurement signals, and a member for displaying time and measured distance. The device also includes a power supply, an electrical driving member and an electronic control unit for the driving and control of the member. A processor having a data-storage program is arranged to store match data in a storage unit. At least one input member is available for access from the outside of the housing. The play-interrupting events are registered in registries in the storage unit corresponding to the menus. The device is not a simple device, which keeps track of possession of a basketball by the home team or the visiting team. It is not located at the eye level of the referee, and hence does not facilitate accurate, error-free play call.

Non-Patent literature "Alternate Possession Switch" at http://www.ump-attire.com/Merchant2/merchant.mv?Screen=PROD&Product_Code=FLIP58&Categor y_Code= discloses an alternate position switch that may be flipped from a vertical white showing position, indicating home team position, to a horizontal black position, indicating visitor team possession. The "Alternate Possession Switch" non-patent publication discloses a device that has to be attached to a whistle using double side tapes. As such, the device is not an integral part of the whistle. The double-sided tape attachment bond is insecure, especially when the ambient temperature is too cold or warm, as indicated in the manufacturer's literature. Therefore, the whistle is not equipped with possession integration features. Moreover, the vertical/horizontal flip is not indicated to be locking. Accordingly, the flip mechanism may close down when placed in the pocket of a referee, contributing to an inaccurate play call.

Notwithstanding the efforts of prior art workers, there remains a need in the art for a whistle that accurately keeps track of basketball possession and indicates that information to the referee at the eye level, permitting accurate game calls by the referee. The whistle also is required to display the basketball possession information to surrounding players so that they can be quickly positioned for the game play called by the referee.

SUMMARY OF THE INVENTION

The present invention relates to a basketball sports whistle with a team possession indicator. In particular, the sports whistle includes a sports whistle with a sliding indicator and/or protruding tag display located on top of the whistle near the mouthpiece at the eye level of the referee.

Briefly stated, the invention involves a whistle with possession control indicating feature integrated therein. Particularly, the whistle with possession control indicating system generally comprises: (i) a whistle body; and (ii) a possession control means integrated within the whistle body. The possession control means comprises a possession indicator appointed to designate first and second positions. Preferably, the first position and second position are associated with a first designation H for "Home" and a second designation V for "Visitor". The indicating feature may be a slider that is moved from H to V or a pop-up button wherein either H or V pops out of the top surface of the whistle. In operation, a referee moves the possession indicator from the first position to the second position, signifying possession of the ball. In a second embodiment, the referee's selection of either Home or Visitor causes vertical protrusion of a pop-up feature that has a corresponding color-coded display element. This popped up protrusion does not accidentally undergo a status change; but remains locked in the previously selected position. In a third embodiment, only a single popped up protrusion is used. A popped-up condition of the protrusion indicates possession for the visitors, while a pressed down condition of the protrusion indicates that ball possession is with the home team. The single popped up protrusion may have a marking indicating V for visitor possession. In either case, the basketball possession indicator is visible to the referee at eye level. At the same time, the ball possession indicator is also visible to the surrounding players. Accordingly, players in the near vicinity of the referee are accorded an opportunity to prepare for the next play and properly position themselves on the court.

BRIEF DESCRIPTION OF THE DRAWINGS

The invention will be more fully understood and further advantages will become apparent when reference is made to the following detailed description of the preferred embodiments of the invention and the accompanying drawings, in which.

DETAILED DESCRIPTION OF THE INVENTION

Figure 1:
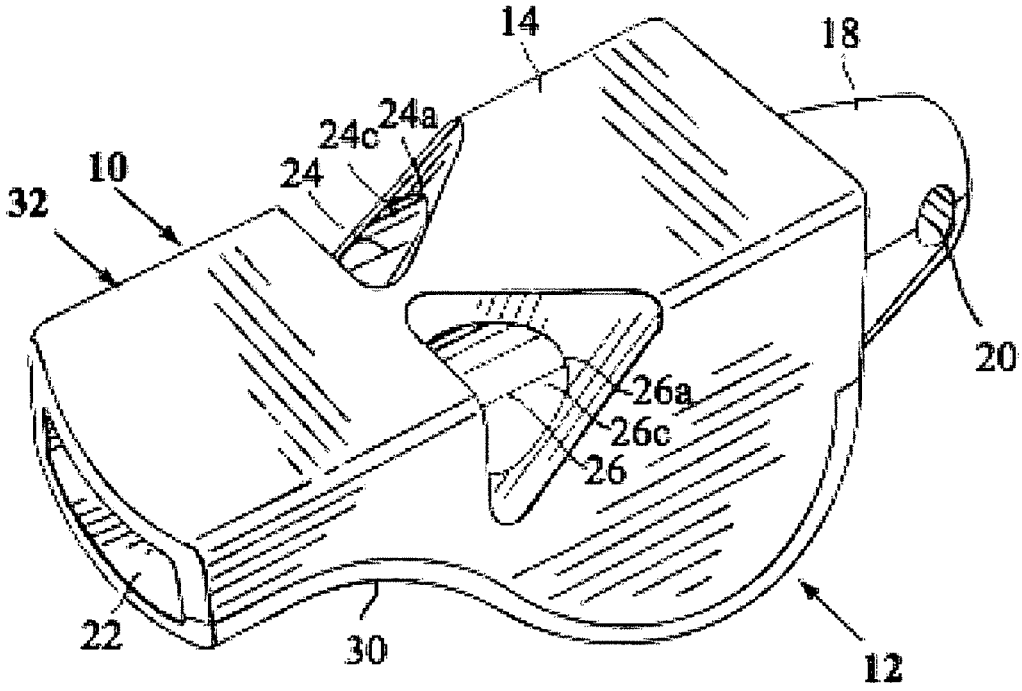
FIG. 1 illustrates a prior art sports whistle disclosed in U.S. Pat. No. 4,821,670.

This invention relates to a whistle equipped with an integral possession control indicating system. Specifically, the Whistle with Possession Control generally comprises: (i) a whistle used by a referee for signaling a player triggered possession determining event in a basketball game; and (ii) a possession control indication means that keeps track of whether the home team or visitor team currently has possession of the ball. This indication means prevents referee distraction and referee call errors.

Briefly stated, the invention involves a whistle having a possession control mechanism integrated therein (hereinafter the 'Whistle with Possession Control"). Particularly, the 'Whistle with Possession Control generally comprises: (i) a whistle body; and (ii) a possession control means integrated within the whistle body. The possession control means comprises a possession indicator appointed to designate first and second positions. Preferably, the first position and second position are associated with a first designation H for "Home" and a second designation V for "Visitor". In operation, a referee moves the possession indicator from the first position to the second position, signifying possession of the ball.

More specifically, during operation at a Basketball Game, the referee often runs up and down the court officiating. Not infrequently, he watches closely as two players dive for the ball. When both come up clutching it, he blows his whistle, and signifies that the "Red Shirts" have possession. The next time two players from opposing sides become involved in a contest for the ball, with each player holding onto part of it, the referee again blows his whistle, and signifies that the "White Shirts" have possession. This sequence is typically repeated as many as 30 or 40 times each game, with possession alternating between the two sides (instead of the players becoming involved in a "jump ball" event).

The referee keeps track of which side last had possession by moving a rubber band from one wrist to the other each time he signifies that one side has possession. Another method used by the referee to track the side, which stands to gain possession by the jump ball event is to move the whistle from one pocket to the other. In such situations, focus is deflected when shifting the rubber band between wrists, or moving the whistle between pockets. This contributes to mistakes which, in turn, create bad calls or controversies over calls, angering fans, and degrading the game environment. To make matters worse, it is typical for a young student to be running the direction arrow machine. Parents and fans, as well as coaches oftentimes try to keep track of which side is entitled to possession on the next jump ball event. It is not surprising that the attitude of those in attendance is heavily influenced by the accuracy of the referee responsible for determining possession control.

The present invention provides a method and means for determining possession control in an efficient, accurate manner. Possession is determined effortlessly without loss of focus (which can cause a referee to miss court activity, such as fouls, that would otherwise be seen). A whistle of the type used in a basketball game is provided with a slide or a pop-up indicator provided on the top surface of the whistle at the eye level of the referee. The slider can be readily moved from a first position to a second position. The pop-up indicator involves either H for home team or V for visitor team shown popped up while the other indicator is below the top surface of the whistle. The referee blows the whistle when spotting a jump ball event, and moves the slide from the first position to the second position or pops the appropriate indication. Preferably, the first position is associated with a first designation, such as (V), and the second position is associated with a second designation such as (H). The next time that the whistle is blown, the slide is moved from the second position to the first position, or the popped up indicator pressed to reveal V signifying that the "Visitor" is to be accorded possession of the ball.

FIG. 1 illustrates a prior art sports whistle disclosed in U.S. Pat. No. 4,821,670. Such a whistle is representative of the type of whistle structure on which the present invention has improved. The whistle is intended for sports referees and delivers a loud piercing sound. The whistle has a mandolin shape, having a narrow front portion 10, corresponding to an elongated neck, which constitutes the mouthpiece 22 of the whistle, and a bulbous partially circular rear portion 12 which accommodates three fipple-type whistle elements 24, 24*a*, 24*c*, 26, 26*a* and 26*c*. The first molding part 32 is approximately U-shaped in transverse cross-section and provides the flat common top face 14 (or common bottom face if the shape is inverted) and the two spaced parallel sidewalls of the mouthpiece. These two sidewalls extend downwards providing the curved edges for the curved lower wall 30, and the corresponding part of the rounded bulb of the flat-topped mandolin shape. The whistle is blown at mouthpiece 22. The common top face, 14 of the front and rear portions are substantially flat. The lower surface of the open front end of the mouthpiece is provided with a downward protuberance to facilitate gripping it between the lips and the teeth of the user and to help in its retention in the mouth. A boss 18 protrudes centrally from the rear end and is provided with a transverse bore 20 to receive a split ring used for attachment of a lanyard, chain, etc. to retain the whistle around the user's neck, or on the user's clothing, etc.

Figure 2:
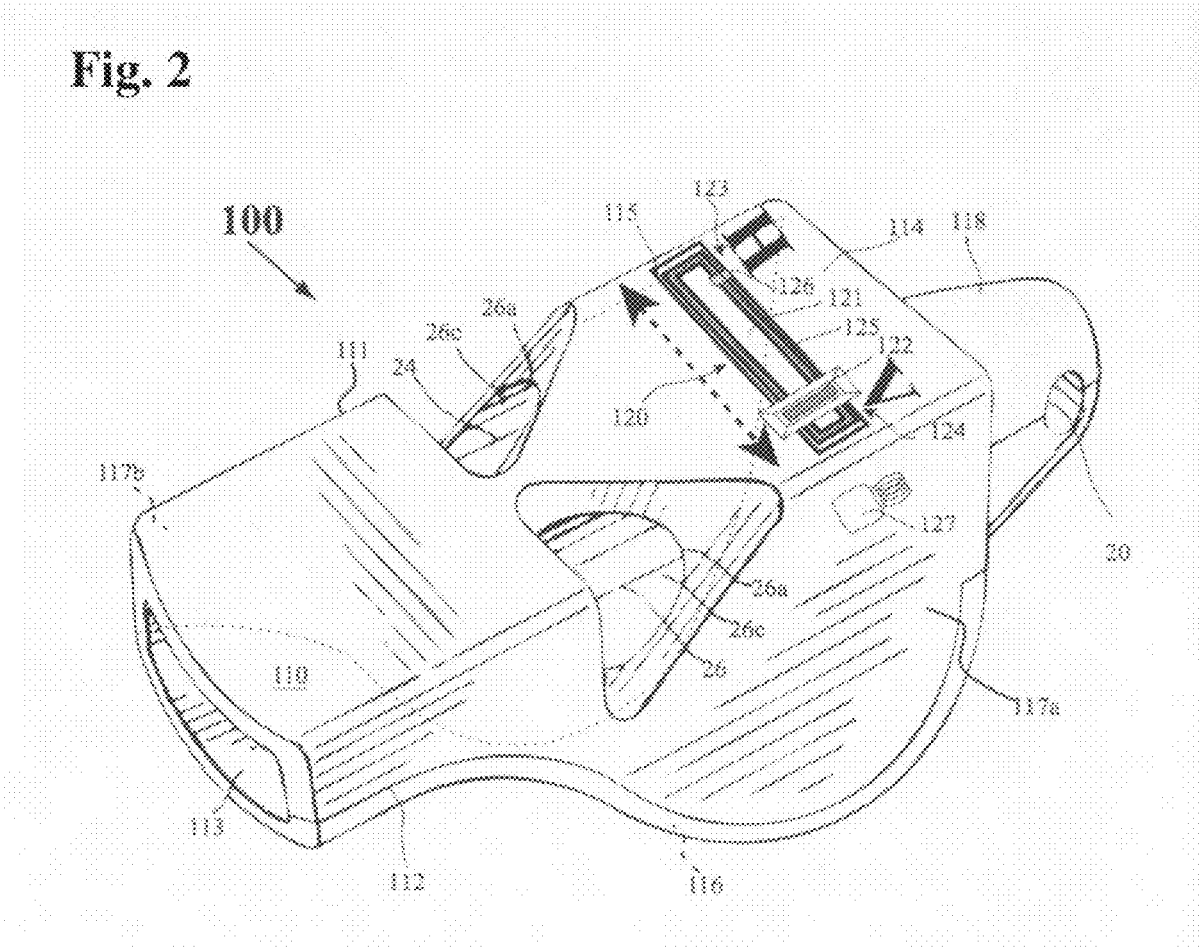
FIG. 2 illustrates a first embodiment of a whistle having a possession control indicating system, and which includes a slider that keeps track of basketball possession in accordance with the present invention.

FIG. 2 illustrates the first embodiment of a whistle with possession control indicating system in accordance with the present invention. This whistle is similar in functionality to that detailed in FIG. 1 except that it has an integrally attached possession control indication device in the form of a slider that can be moved from a first indication to a second indication. Shown generally at 100 is a topside view of a sport whistle having possession control integrated therewith. The whistle body shown is merely an example of a preferred embodiment; however, the whistle can have a plethora of shapes and sizes. A whistle 110 is provided which is intended for use by sports referees and delivers a loud piercing sound. Whistle 110 is generally constructed having a front portion 111, an elongated neck 112 constituting a mouthpiece 113, and a bulbous partially circular rear portion 114 with boss 118. The whistle 110 preferably accommodates three fipple-type whistle elements 24, 24*a*, 24*c*, 26, 26*a* and 26*c* similar to that illustrated in FIG. 1. Whistle 110 includes a top face 115 that is substantially flat, a lower face 116 and sidewalls 117*a*, 117*b*. A possession control means 120 is integrated into whistle 110. Herein, possession control means 120 is integrated into top face 115 near mouthpiece 113 of front portion 111; however, possession control means 120 may be integrated generally on any portion of the body of whistle 110, including sides 117*a*, 117*b* or on rear portion 114 as long as it is at the eye level of the referee and is readily visible. Here also transverse bore 20 to receive a split ring used for attachment of a lanyard, chain, etc. to retain the whistle around the user's neck, or on the user's clothing, etc.

Possession control means 120 is generally provided as a slide on top face 115, and is constructed having an opening 121 in communication with a possession indicator 122. Possession indicator 122 is appointed to slide from a first position 123 to a second position 124. Preferably, first position 123 and second position 124 are associated with a first designation H for "Home", and a second designation V for "Visitor", respectively. In operation, a referee blows whistle 110 when spotting a jump ball event, and moves possession control means 120 from first position 123 to second position 124, signifying that the "Visiting Team" is to be accorded possession of the ball, as shown. The next time whistle 110 is blown, possession indicator 122 is moved from second position 124 to first position 123, signifying that the "Home Team" is to be accorded possession of the ball. The slider contacts the friction element, which in this case is a pad 125 preventing accidental movement of the indicator from the assigned position even when the sports whistle is inserted in a pocket. Additionally a detent 126 may be provided at the H end and V end (only the detent at H is shown since the detent below V is covered by the slider 122) to lock the accidental movement of the slider 122.

Possession control means 120 may be constructed as a slide that has two openings and is flush with the whistle, so that a first opening reveals a black "V" and the second opening reveals a white "H". Alternately, possession control means 120 can have a small bump or detent, which would be felt as it is moved from the first position to the second position, and vice versa. Further, possession control means 120 could have a raised portion, which is moved between the first and second positions. In each case, the referee is readily apprised of the side entitled to possession. Erroneous calls are decreased, vigilance is increased, and officiating is significantly improved. In another embodiment, an electronic means 126 can be provided in the sports whistle that is powered by a local battery receiving the information of the referee selected position and communicating this information using a local antenna within the electronic device 126 to an external computer which may be used to display on a scoreboard or on an electronic display means. In any case, the possession of the ball is clearly visible at the eyelevel of the referee, and a ball call may be easily made without error and without having to remove the whistle from the mouth. There is no need for the referee to look around for other devices prior to calling a ball play.

Figure 3:
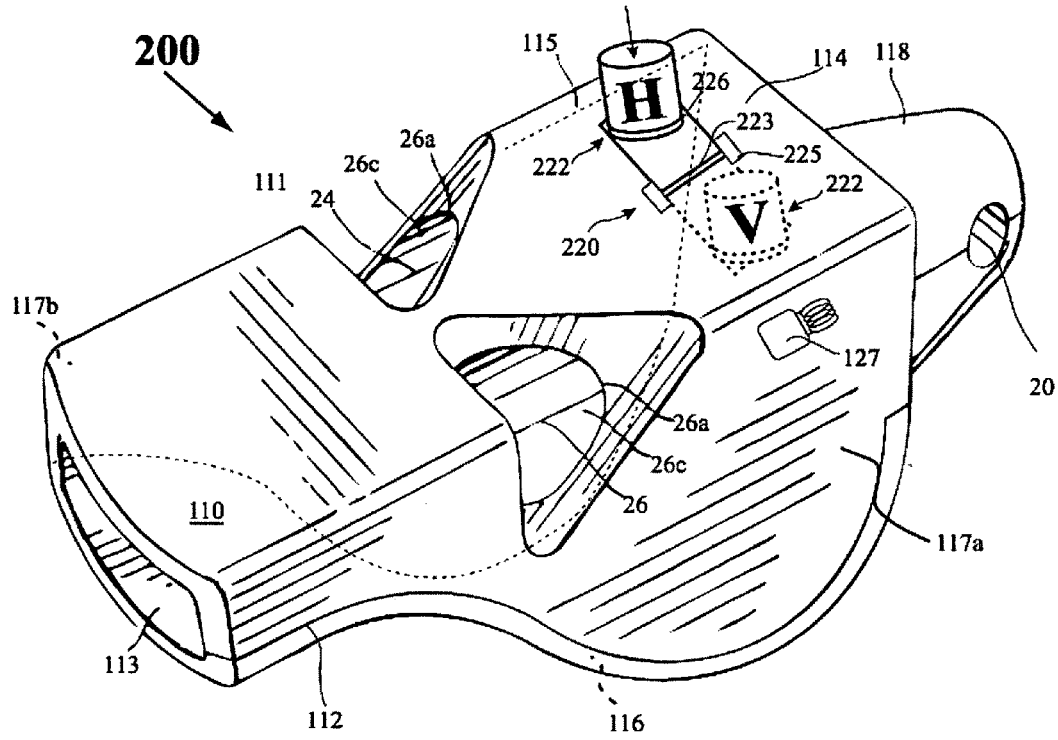
FIG. 3 illustrates a second embodiment of a whistle having a possession control indicating system, and which includes a pop-up protrusion that keeps track of which team is entitled to possession of the basketball in accordance with the present invention.

FIG. 3 illustrates at 200 a second embodiment of a whistle with a possession control indicating system in accordance with the present invention. Similar numbering of components of the whistle as that detailed in FIG. 2 is used for consistency. However, the detail of possession control indicator is different in this embodiment and is detailed at 220.

Possession control means 220 is generally provided as a pop-up indicator on top face 115, and is constructed having a hinge 223 that carries a flat piece to which indicator protrusions H at 221 and V at 222 are attached. When either the H or V protrusion is pressed, V or H pops up respectively in a see-saw like action. The hinge is provided with sufficient friction provided by friction pads 225 pressing against shaft 223. Detent 226 is shown as a circular projecting ridge on the H pop up indicator. A similar circular projecting ridge detent is provided on V pop up indicator to prevent accidental switching of the popped up indication. In FIG. 3, H is popped up while the V indication is below the top surface 115 of the whistle, concealed from the view at eyelevel of the referee. When the referee blows the whistle, the popped-up indication is pressed, signifying that the basketball possession has changed from home H to visitor V, which now will be in the popped-up condition. These popped up indications may be electronically communicated to a scoreboard.

The whistle with possession control indication system of the subject invention comprises, in combination, the following salient features:

i) A whistle with a top flat surface adapted for receiving integrally an indication device that keeps track of basketball possession readily visible at the eye level of the referee;

ii) Said indicating device having a first position and a second position indicating the possession of a basketball by the home team and possession of a basketball by the visitor team;

iii) Said indication device having friction or detent means for preventing accidental switching of the indications from a previously set indication by the referee;

iv) Said indication means being a slider with a home position and a visitor position prevented from accidental sliding by the friction between the indicating element and the slider;

v) Said indication element is a pop-up device that either pops up a home team indication or a visitor team indication in a see-saw manner with a hinge that is provided with friction means or detent means;

vi) Said indicator being a single pop-up element that pops up when pressed once and pops down when pressed again, indicating the possession of the basketball by a team indicated in the pop-up single indicator, which may be either V or H;

whereby a referee is provided with immediate accurate indication of possession of the basketball as the referee blows the whistle and activates the possession control indication of basketball possession and to accurately and reliably record current possession preventing erroneous referee calls.

Having thus described the invention in rather full detail, it will be understood that such detail need not be strictly adhered to, but that additional changes and modifications may suggest themselves to one skilled in the art, all falling within the scope of the invention as defined by the subjoined claims.

What is claimed is:

1. A basketball sports whistle system comprising:

a. a flat top surface of said basketball sports whistle having an integrally attached possession indication element visible at eye level of a referee;

b. said possession indication element pointing to a first position or a second position set by a referee while monitoring basketball play without taking eye off the play field;

c. locking means for said possession indication element preventing accidental switching of the indications from a previously set indication;

whereby a referee is provided with immediate accurate indication of possession of a basketball without taking eyes off current play as the referee blows the whistle and activates the possession control indication element to accurately and reliably record current possession preventing erroneous referee calls.

2. The basketball sports whistle system as recited by claim 1, wherein the locking means is a friction element.

3. The basketball sports whistle system as recited by claim 1, wherein the locking means is a detent element.

4. The basketball sports whistle system as recited by claim 1, wherein the possession indication element is a slider having a 'H' representing home basketball possession and 'V' representing visitor basketball possession.

5. The basketball sports whistle system as recited by claim 4, wherein the possession indication element is a slider with a friction lock preventing accidental switching of basketball possession indication.

6. The basketball sports whistle system as recited by claim 1, wherein the possession indication element is a pop-up element popping either having a 'H' pop-up indication representing home basketball possession or pop-up indication 'V' representing visitor basketball possession in a see-saw hinge like arrangement.

7. The basketball sports whistle system as recited by claim 6, wherein the see-saw hinge like arrangement is provided with friction lock or a detent lock preventing accidental switching of basketball possession indication.

8. The basketball sports whistle system as recited by claim 1, wherein the possession indication element is a single pop-up element popping either having a 'H' pop-up indication representing home basketball possession or pop-up indication 'V' representing visitor basketball possession in a one push pop-up and a second push pop down sequential arrangement.

9. The basketball sports whistle system as recited by claim 1, wherein the possession indication element communicates electronically with a scoreboard enabling display of current basketball possession.

10. The basketball sports whistle system as recited by claim 1, wherein the whistle has three reeds providing loud audible referee call over long distances.

* * * * *